US011969640B2

(12) United States Patent
Wagner

(10) Patent No.: US 11,969,640 B2
(45) Date of Patent: Apr. 30, 2024

(54) GOLF BALL PUTTING PRACTICE TARGET, COLLECTION, AND STORAGE APPARATUS

(71) Applicant: Daniel Joseph Wagner, Naperville, IL (US)

(72) Inventor: Daniel Joseph Wagner, Naperville, IL (US)

( * ) Notice: Subject to any disclaimer, the term of this patent is extended or adjusted under 35 U.S.C. 154(b) by 189 days.

(21) Appl. No.: 17/323,095

(22) Filed: May 18, 2021

(65) Prior Publication Data

US 2022/0370876 A1 Nov. 24, 2022

(51) Int. Cl.
*A63B 69/36* (2006.01)
*A63B 47/02* (2006.01)

(52) U.S. Cl.
CPC ..... *A63B 69/3676* (2013.01); *A63B 47/02* (2013.01)

(58) Field of Classification Search
CPC .... A63B 69/3676; A63B 47/02; A63B 47/002
See application file for complete search history.

(56) References Cited

U.S. PATENT DOCUMENTS 3,659,891 A * 5/1972 Pettenon ..... E01H 1/1206 294/1.4
3,663,049 A * 5/1972 James ..... A63B 47/02 294/19.2
D461,027 S * 7/2002 Gardner ..... D30/162
6,513,845 B2 * 2/2003 Campomane ..... A63B 71/0045 206/315.9
8,684,429 B1 * 4/2014 Holub ..... E01H 1/1206 294/1.4
2004/0164568 A1 * 8/2004 Diehl ..... E01H 1/1206 294/1.4
2006/0116224 A1 * 6/2006 Andersen ..... A63B 47/02 473/446
2010/0314893 A1 * 12/2010 Pearson ..... A63B 47/02 294/19.2

FOREIGN PATENT DOCUMENTS

WO WO-9737729 A1 * 10/1997 ..... A63B 47/02

* cited by examiner

*Primary Examiner* — Joshua T Kennedy

(57) ABSTRACT

A device for golf putting practice that is an all-in-one golf ball target cup, golf ball collection and storage bag for up to two dozen golf balls. A target cup quadrilateral tube front section is connected to a pole with handle. A ball storage bag is connected to the rear portion of the target cup which is partially circular with a flat bottom. The device allows for maximum amount of golf ball practice putts in a very short period of time. Balls are dropped on the practice putting surface from the device storage bag. The self-balancing device is placed at the desired putting target location and putting practice can begin. Ball collection is completed with the device without bending over, reducing the work and time required.

1 Claim, 3 Drawing Sheets

GOLF BALL PUTTING PRACTICE TARGET, COLLECTION, AND STORAGE APPARATUS

FIELD OF THE INVENTION

Golf putting practice is physically exerting and time consuming; since it requires constant ball locating and bending over for ball retrieval. This invention is a golf ball putting training device that provides a target cup, ball collection, and storage for up to two dozen golf balls. This device allows for maximum amount of golf ball practice putts in a very short period of time. Balls are dropped on the practice putting surface from the device storage bag. The device is placed at the desired putting target location and putting practice can begin. Said device is balanced to stand upright independently. The target cup has the approximate width of a golf cup hole. Ball collection is completed with the device without bending over, reducing the work required. The pole handle allows the player to scoop missed putted balls through the target cup and into the collection bag. The balls that were hit into the cup are already collected in the collection bag.

DESCRIPTION OF RELATED APPLICATIONS

Any discussion of the prior art throughout the specification should in no way be considered as an admission that such prior art is widely known or forms part of common general knowledge.

Prior art of Holub (U.S. Pat. No. 9,694,429) consists of a handle that is connected to a frame and a frame that is connected to a bag for debris collection. The Holub frame structurally differs from the target cup in this application. The target cup consists of a quadrilateral tube front portion and a partially circular flat bottom rear portion. The target cup is similar in width to a golf cup hole for realistic practice. The target cup design balances the weight of the assembly in order to stand upright independently to accept the putted golf ball. The target cup is unique compared to frame of Holub.

BRIEF SUMMARY OF THE INVENTION

This device consists of a target cup with snap screws, collection bag with snaps, pole handle adapter with nut, and pole handle. This device is unique and novel, relative to prior art, since it performs all-in-one putting target, ball collection and storage functions, the target cup consists of a quadrilateral tube front section and a partially circular rear section with a flat bottom. This structural characteristic is necessary to allow the device to balance itself upright allowing the golf ball rolls into and through the target cup smoothly.

Putting practice is typically carried out on a practice green with a golf hole cup. The purpose of this device is to provide an improved alternative allowing more practice strokes with reduced physical demand. The device balances vertically allowing a player to set the target cup, putt many balls to the target, and collect all the balls; all without bending over. Made putts are already in the storage bag and missed putts are scooped up. Balls in the bag can be dumped out on the practice surface and the device can be set to the new target location. Many putts can be practiced in a very short time and with minimal physical assertion. This device is unique and novel, relative to prior art, due to the design of the target cup.

DRAWINGS—REFERENCE NUMERALS

1: Target Cup
2: Collection and Storage Bag
3: Pole handle with male thread
4*a*: Pole Adapter with female threads and bolt
4*b*: Locking Nut
5*a*: Snap Cap
5*b*: Female Snap
6: Male Snap

DETAILED DESCRIPTION OF THE INVENTION

Figure 1:
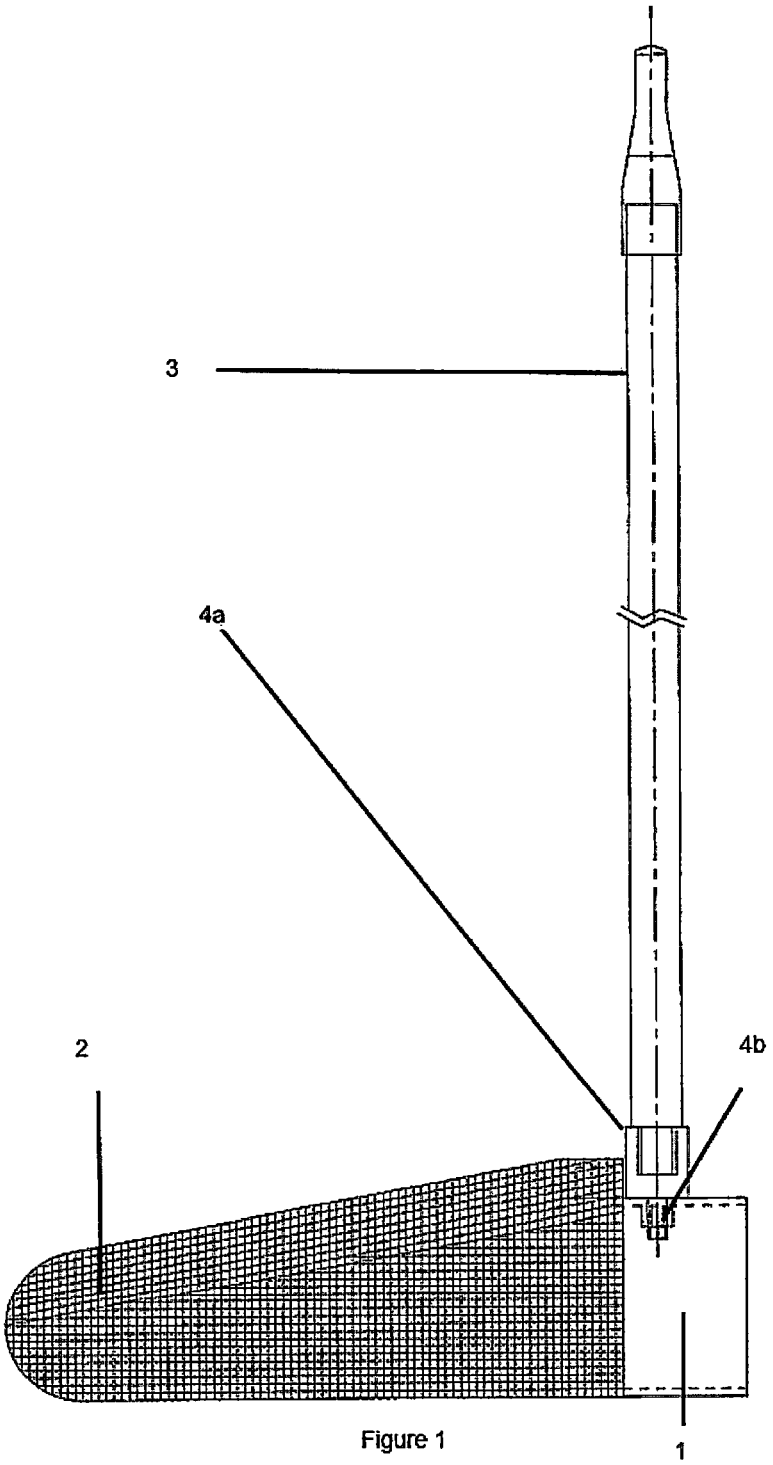
FIG. 1: Side View of Assembly Major Components; Target Cup 1, Mesh Bag 2, Male threaded Pole with handle 3, Pole adapter with female threads and bolt 4*a*, and Locking Nut 4*b*.
Figures 2A, 2B:
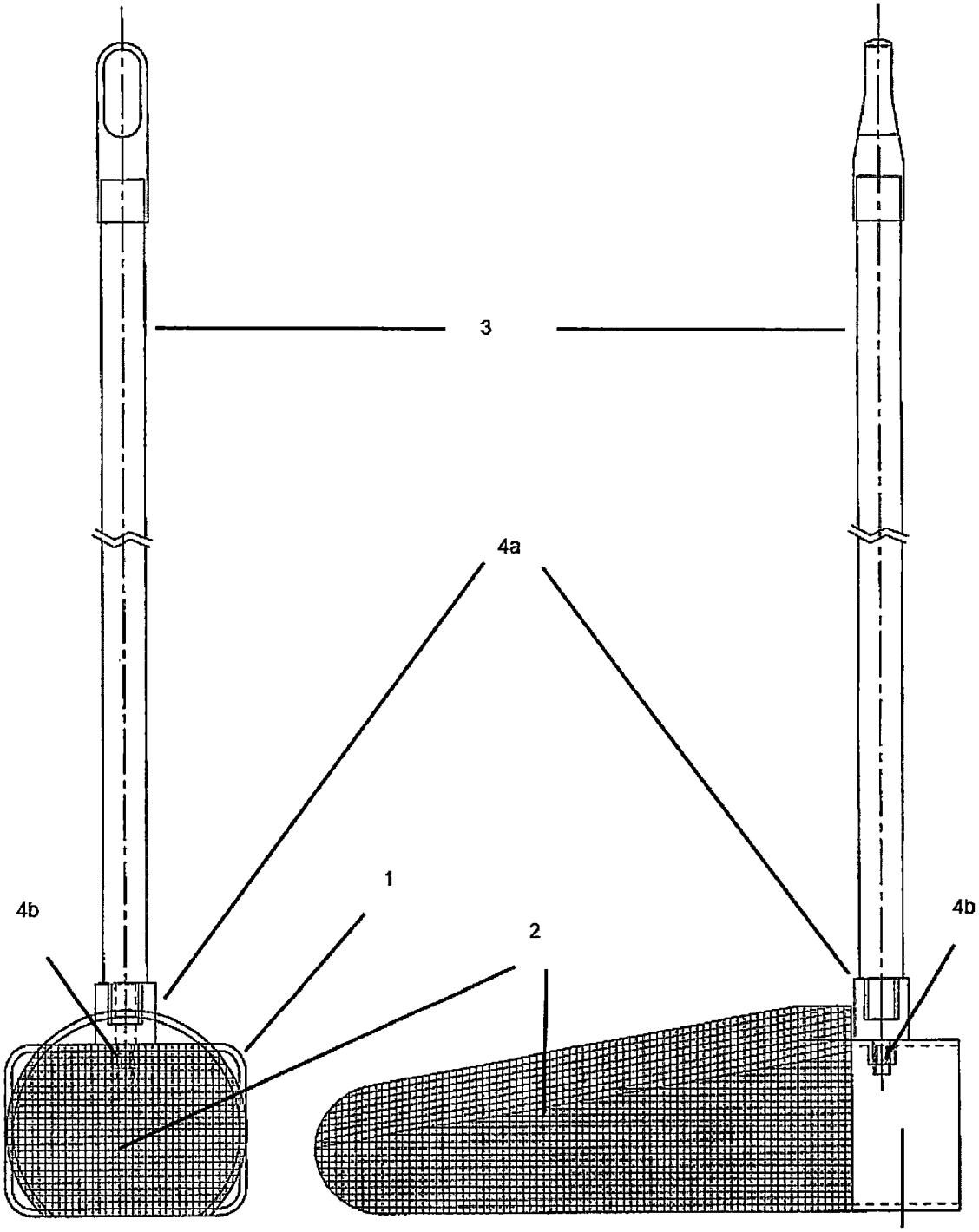
FIG. 2*a*: Front View of Assembly Major Components; Target Cup 1, Mesh Bag 2, Male threaded Pole with handle 3, Pole adapter with female threads and bolt 4*a*, and Locking Nut 4*h*.
FIG. 2*b*: Side View of Assembly Major Components; Target Cup 1, Mesh Bag 2, Male threaded Pole with handle 3, Pole adapter with female threads 4*a*, and Locking Nut 4*b*.
Figures 3A, 3B:
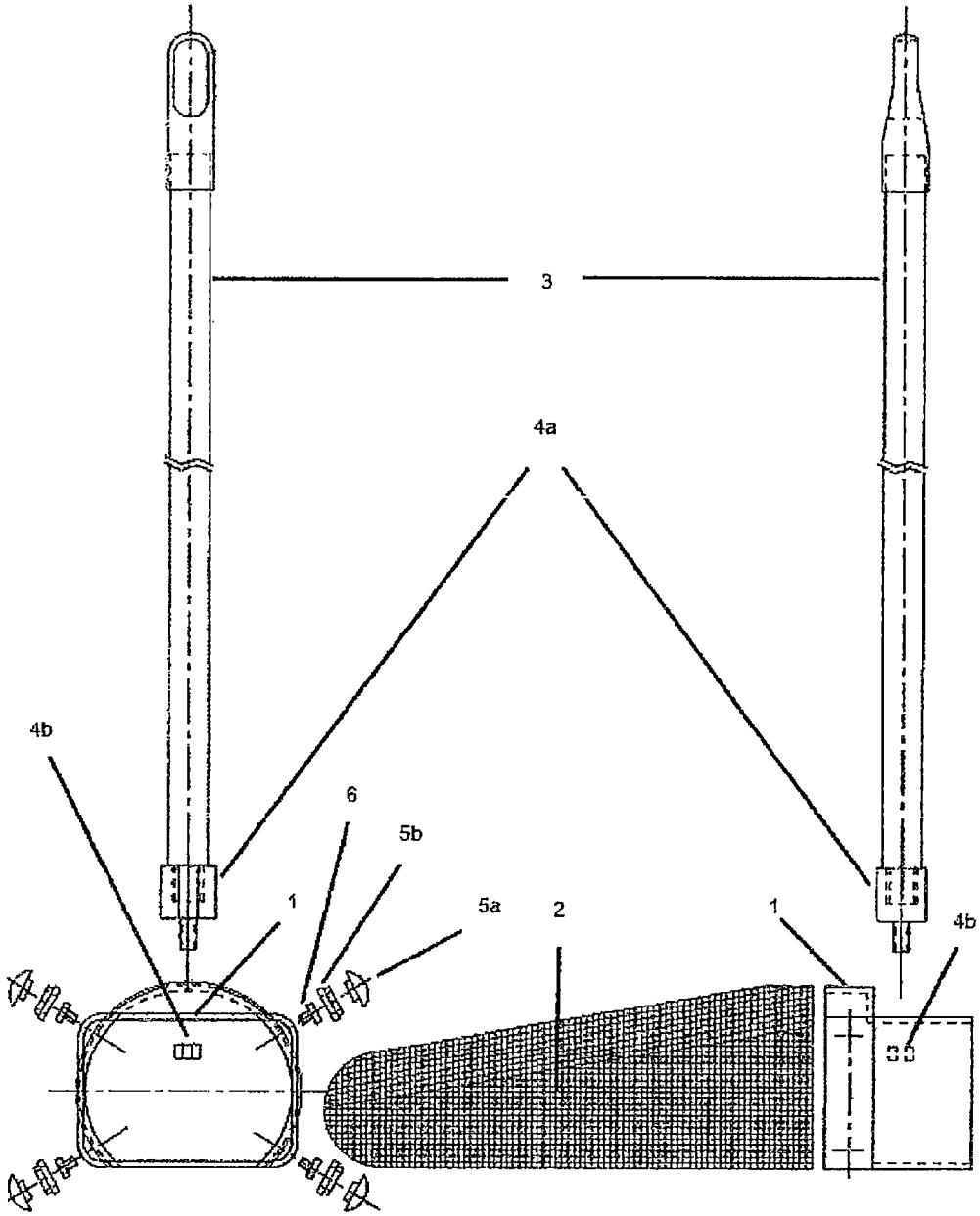
FIG. 3*a*: Front View of Complete Assembly; Target Cup 1, Mesh Bag 2 (not shown), Male threaded Pole with handle 3, Pole adapter with female threads and bolt 4*a*, Locking Nut 4*b*, Snap cap 5*a*, female snap 5*b*, and female screw snap 6.
FIG. 3*b*: Side view of Assembly Major Components; Target Cup 1, Mesh Bag 2 (not shown), Male threaded Pole with handle 3, Pole adapter with female threads 4*a*, and Locking Nut 4*b*.

In FIG. 1, the device is in golf putting target position and balanced on the putting surface. The made putted ball is designed to enter the target cup 1 and roll through to the mesh collection and storage bag 2.

In FIG. 1, the device is also in the golf ball collection position. Balls are collected by using the target cup 1 as a scoop and lifting the device with the pole handle to push balls through the target cup and into the mesh bag for collection and storage 2. Alternatively, a putter or foot can be used to force balls into the target cup. The pole handle 3 acts is the handle of the device. The device can be stored just like a golf club in the players golf bag. The balls can be accessed directly from the device as needed. Also, the removeable mesh bag acts as a golf ball storage bag allowing the player to bring to any location.

Method of Manufacture

The present device design consist of an assembly of a modified standard PVC downspout to drain adapter, a broom handle adapter, sport mesh bag with drawstring, clothing/canvas screw snaps, and a shortened broom pole. This is very economical, however future designs will likely involve customized components to reduce the manufacturing costs and improve the functionality of the device.

Method of Use

This device allows putting practice on carpeting or golf putting green. It can collect up to two dozen golf balls allowing for practice repetition. The player can putt to the target followed by ball collection. The bag full of balls becomes a storage bag that can easily be detached and placed in the golf cart or anywhere else.

Ball Target Use: The device is placed on the putting surface in a balanced and resting position. The successfully made golf ball hits target cup and enters the cup front, rolls through the cup, and enters the collection bag.

Ball Collection Use: The device pole handle is held up vertically and cup front is placed directly behind the golf ball. The target cup is dragged behind the ball and enters the cup front, rolls through the cup, and exits into the collection and storage bag.

Ball Storage Device Use: The collection bag also stores the balls. The device can be placed in the golf bag. Balls can be removed by hand or the bag can be detached and carried away.

VARIATIONS

The spirit of the present invention is to be a combined target, collection, and storage device for two dozen golf balls. The parts that make up this device may be optimized dimensionally, and the components may be customized further. Improvements and changes to the device may include cup thickness and shape, materials of construction, type and size of collection beg, types of adapters for the pole adapter, type of fastener for the bag to cup connectors, and type of pole-handle.

The invention claimed is:

1. A golf ball putting practice target, collection and storage device, comprising:

a base portion that has a mass center of gravity such that it is configured to balance vertically on a playing surface, the base portion having a quadrilateral tube entrance portion of width similar to a golf hole cup having a first flat bottom portion, and a partially circular portion adjacent said quadrilateral tube portion bottom having a second flat bottom portion coplanar with said first flat bottom portion;

a pole secured to said quadrilateral tube entrance portion via an adapter, said pole having a handle;

a ball collection and storage bag;

said partially circular portion and storage bag each comprising cooperating connectors configured to connect the storage bag to the partially circular portion.

* * * * *